US005261619A

United States Patent [19]

Merriweather, Jr.

[11] Patent Number: 5,261,619

[45] Date of Patent: Nov. 16, 1993

[54] TOILET TISSUE DISPENSER WITH LOCK

[75] Inventor: Frank Merriweather, Jr., Lawndale, Calif.

[73] Assignee: Bobrick Washroom Equipment, Inc., North Hollywood, Calif.

[21] Appl. No.: 836,355

[22] Filed: Feb. 18, 1992

[51] Int. Cl.[5] ..... B65H 75/18

[52] U.S. Cl. ..... 242/55.3; 242/55.2

[58] Field of Search ..... 242/55.2, 55.3, 55.53; 403/331

[56] References Cited

U.S. PATENT DOCUMENTS

| | | | |
|---|---|---|---|
| 479,971 | 8/1892 | Carr | 242/55.2 |
| 1,046,474 | 12/1912 | Marcuse | 242/55.2 |
| 1,687,741 | 12/1923 | Swift | 242/55.2 |
| 2,510,537 | 6/1950 | Agamaite, Jr. | 242/55.3 |
| 2,735,684 | 2/1956 | Longee et al. | 242/58.6 |
| 3,871,593 | 3/1975 | Brinton | 242/55.53 |
| 4,025,004 | 5/1977 | Massey | 242/55.3 |
| 4,690,343 | 9/1987 | Goetz | 242/55.3 |
| 4,807,823 | 2/1989 | Wyant | 242/55.3 |
| 4,913,365 | 4/1990 | Shamass | 242/55.2 |

FOREIGN PATENT DOCUMENTS

| | | | |
|---|---|---|---|
| 0332931 | 9/1989 | European Pat. Off. . | |
| 110331 | 10/1917 | United Kingdom . | |
| 177242 | 3/1922 | United Kingdom . | |
| 199974 | 7/1923 | United Kingdom . | |
| 2061225 | 5/1981 | United Kingdom | 242/55.2 |

OTHER PUBLICATIONS

Bobrick Toilet and Bath Accessories Catalog, 1991, pp. 32 & 33.

*Primary Examiner*—Daniel P. Stodola
*Assistant Examiner*—John F. Rollins
*Attorney, Agent, or Firm*—Harris, Kern, Wallen & Tinsley

[57] ABSTRACT

A toilet tissue dispenser having a frame with a central arm and spaced side arms, and spindles for rolls of tissue, with each of the spindles having opposed spindle pins for rotation in the frame between the central arm and a side arm, opposed slots in the central arm for slidingly receiving a spindle pin of each of the spindles, a locking member carried in the central arm and movable between a locked position blocking the slots and an unlocked position not blocking the slots, and a lock mechanism mounted in the central arm for actuating the locking member.

6 Claims, 2 Drawing Sheets

TOILET TISSUE DISPENSER WITH LOCK

BACKGROUND OF THE INVENTION

This invention relates to toilet tissue dispensers and in particular, to a new and improved toilet tissue dispenser with a spindle for the roll of tissue and with a lock for retaining the spindle in the frame of the dispenser.

Problems with theft of rolls of tissue and with vandalism arise in many installations of tissue dispensers and it is an object of the present invention to provide a simple and inexpensive yet effective lock for retaining spindles in dispensers.

Various forms of roll tissue dispensers are shown in the 1991 catalog of applicant's assignee Bobrick Washroom Equipment, Inc. at pages 32 and 33. Some of these models have a pivoted cover plate with lock.

There are prior patents showing dispensers with locks in other locations. U.S. Pat. Nos. 2,510,537 to Agamaite and to Wyant 4,807,823 show a lock which engages the inside of a hollow spindle. U.S. Pat. No. 4,690,343 to Goetz shows a paper holder with pivoted rods positioned inside the spindle and controlled by a lock.

It is a particular object of the invention to provide a new and improved tissue dispenser with locking arrangement which can be utilized with a single roll dispenser and with a dual roll dispenser. An additional object of the invention is to provide such a dispenser which can utilize a conventional lock and key with the lock sleeve mounted in the frame and with the spindle locking member carried on the lock tumbler. An additional object is to provide such a construction wherein access to the lock and locking member is concealed within the frame of the dispenser.

Other objects, advantages, features and results will more fully appear in the course of the following description.

SUMMARY OF THE INVENTION

A toilet tissue dispenser having a frame with sides and a spindle for a roll of tissue, with the spindle having opposed spindle pins for rotation in the frame sides, a slot in one of the sides for slidingly receiving one of the spindle pins, a locking member carried in the one side and movable between a locked position blocking the slot and an unlocked position not blocking the slot, and a lock mechanism mounted in the one side for actuating the locking member.

The lock mechanism includes a sleeve mounted in the one side and a key operated tumbler rotatably carried in the sleeve, with the locking member carried on the tumbler for rotation into and out of the slot.

In the preferred embodiment, the dispenser is a dual dispenser, with the frame having a central arm and spaced side arms for supporting two spindles. Also the dispenser may have an internal cavity open to the frame mounting surface providing access to the lock tumbler from the mounting surface, and an opening to the cavity for slidingly receiving the lock sleeve, with a screw positionable in the cavity from the mounting surface and engagable with the lock tumbler for retaining the lock in position.

DESCRIPTION OF THE PREFERRED EMBODIMENT

Figure 1:
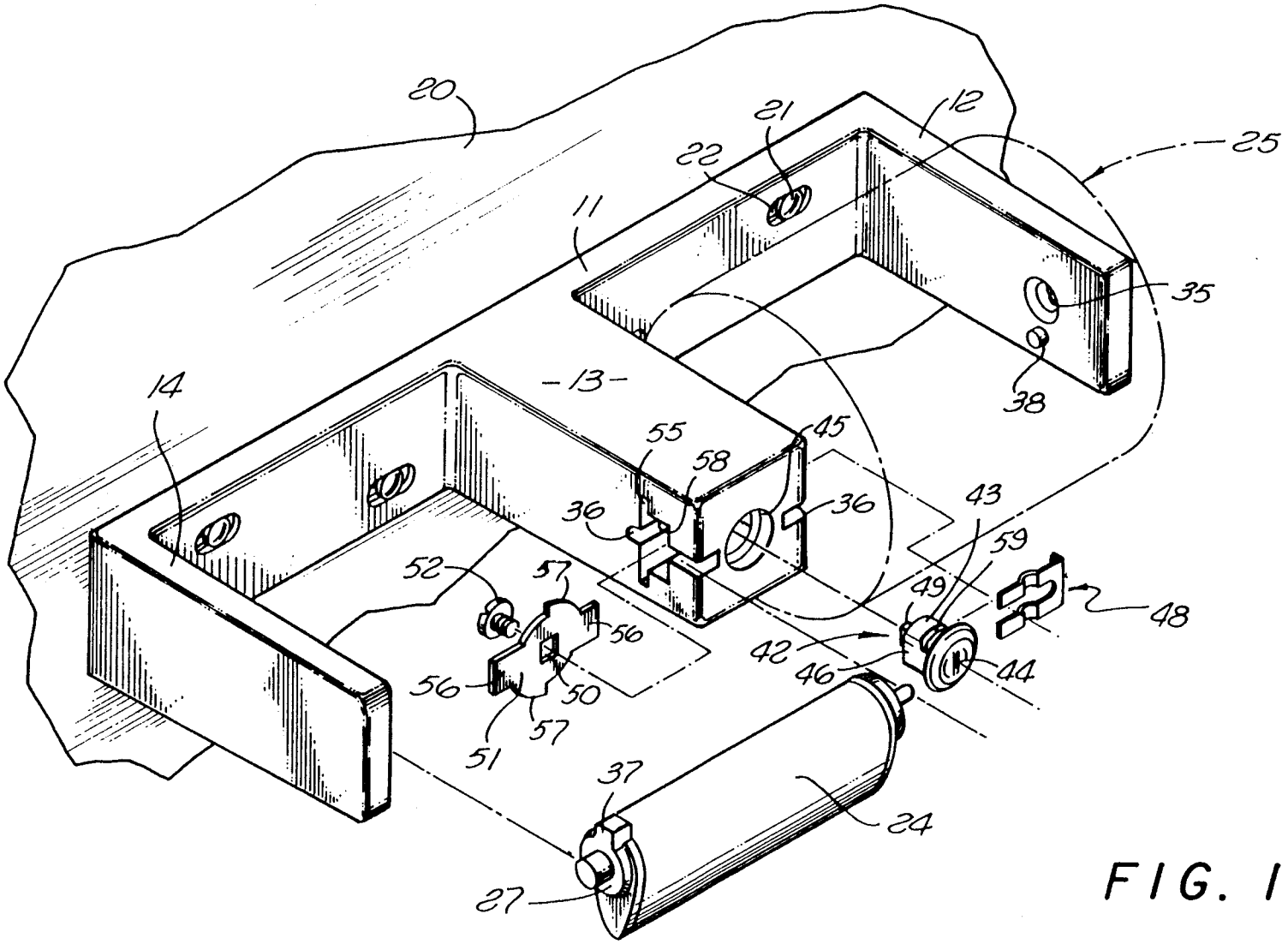
FIG. 1 is a perspective view of a dual toilet tissue dispenser showing the dispenser mounted on a wall with one roll of tissue in phantom lines and incorporating the presently preferred embodiment of the invention.

The dispenser includes a housing or frame 11 with sides in the form of arms 12,13,14. The frame 11 has a mounting surface 16 and typically is a metal casting with cavities 17,18,19 in the arms 12,13,14, respectively. The frame may be mounted on a wall 20 by screws 21 in mounting slots 22.

Spindles 24 are carried in the frame between spaced arms for supporting rolls 25 of toilet tissue. In the embodiment illustrated, the spindles have the features of U.S. Pat. No. 3,871,593. Of course other spindle constructions can be utilized if desired.

Each spindle 24 includes a tube 26 with end caps 27,28. Typically the tube is of metal and the end caps are molded of a suitable plastic. A pin 29 is molded as a portion of the cap 27. Another pin 30 is formed as a U-shaped rod carried in the cap 28, with a spring 31 incorporated for urging the pin 30 outward from the cap 28. Pins, with or without springs, can be used at each end of the spindle if desired and alternatively, integrally molded pins can be used in the caps if desired.

In the embodiment illustrated, the pin 29 of a spindle rotates in an opening 35 in a side arm, and the pin 30 slides into and rotates in a slot 36 in the central arm. A boss 37 molded as a portion of the spindle end cap 27 is positioned to engage a pin 38 projecting inward from the side arm to achieve the controlled delivery feature.

A lock mechanism 42 is carried in the arm 13, with the lock having a sleeve 43 and a key operated tumbler 44 rotating in the sleeve. The lock is positioned in an opening 45 in the arm 13, preferably with flats 46 on the sleeve mating with flats 47 in the opening 45 for preventing rotation of the sleeve. The lock is retained by a spring clip 48 which slides laterally in an opening 58 in the arm 13. The clip 48 is U-shaped and rides in grooves 59 in the lock sleeve 43.

A square boss 49 on the inner end of the tumbler 44 engages a mating opening 50 in a locking member 51, with the locking member preferably being a plate which is held in position on the tumbler by a screw 52. The plate 51 is positioned in a slot 55 in the arm 13. In assembling the locking arrangement, the plate 51 is inserted laterally in the slot 55, the lock 42 is inserted through the opening 45 with the boss 49 entering the opening 50, and the screw 52 is inserted from the mounting surface through the cavity 18. The screw is tightened into the tumbler so that the plate 51 rotates with the tumbler when the appropriate key is utilized. In the embodiment illustrated, the slots 36 and lock mechanism 42 are horizontally disposed, but could be vertically arranged if desired.

In the preferred embodiment, the plate 51 has opposed wings 56 and opposed arcuate sections 57, with each arcuate section having a first portion of one radius and a second portion of a second greater radius, as best seen in FIG. 1.

Figure 2:
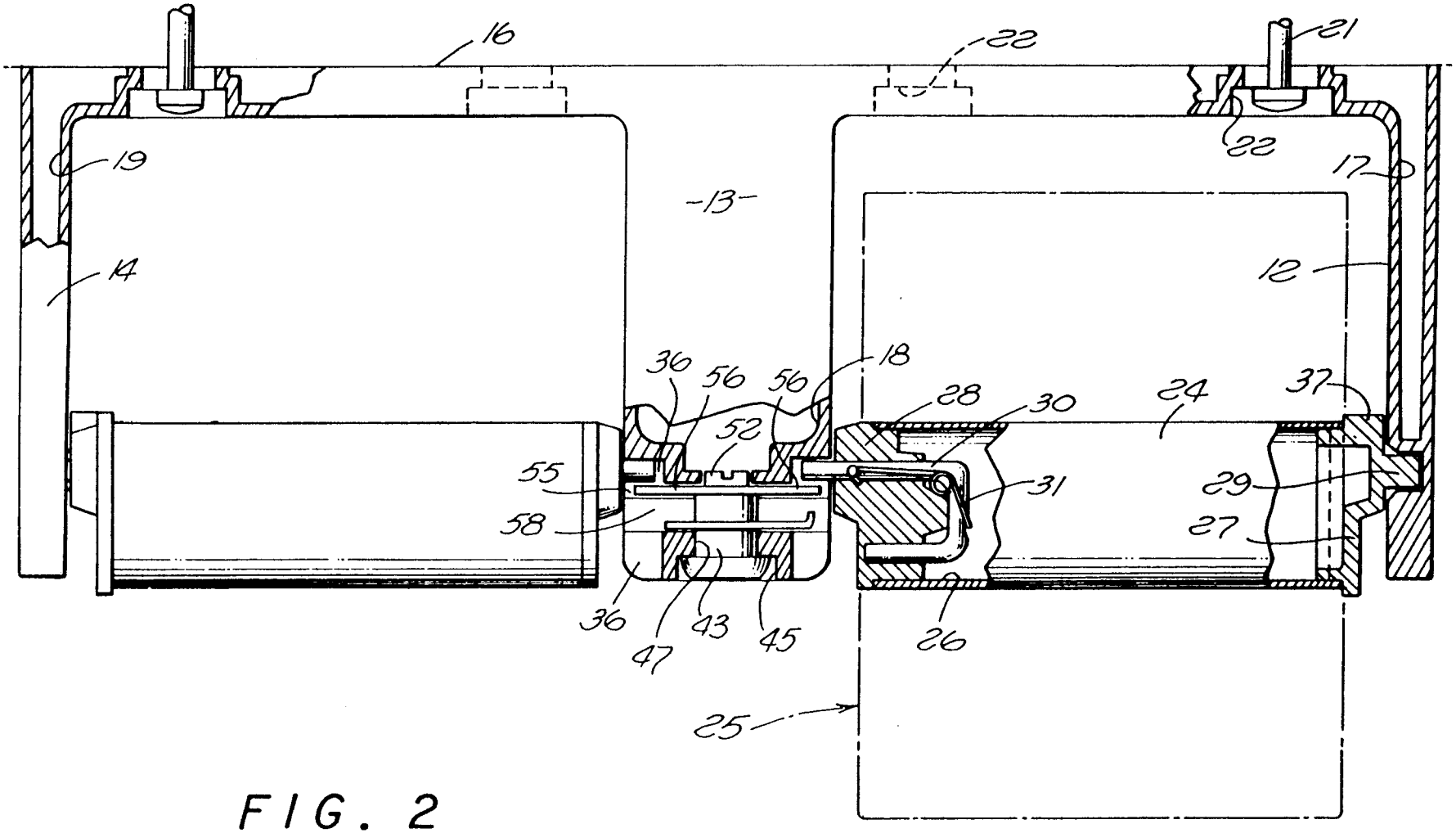
FIG. 2 is a top view of the dispenser of FIG. 1, shown partly in section.

The dispenser is shown in the normal locked position in FIG. 2 with the wings 56 of the locking member 51 closing the slots 36 so that the spindle pins in the slots 36 cannot be moved forward. In order to remove a spindle, the tumbler 44 is operated by a key to rotate the tumbler 90° and move the wings 56 to an unlocked position not blocking the slots 36. This permits pulling the spindle forward to move the pin 31 out of the slot 36 and thereby remove the spindle from the frame. After a roll of tissue is positioned on the spindle, the spindle with roll is inserted into the frame to the position of FIG. 2, and the lock tumbler is rotated to the locked position returning the wings 56 of the locking member to the locked position of FIG. 2.

With this configuration, the lock itself is held in place by the screw 52 which is concealed within the frame and can only be accessed by removing the frame from the wall. Also, the spindle cannot be removed from the frame without actuating the lock to move the locking member from the slot blocking condition to the not blocking condition.

While a dual dispenser has been illustrated and described, the construction with the locking feature can also be utilized in a frame or housing for a single roll of tissue. Also the construction can be used in a hooded roll tissue dispenser, single or double.

I claim:

1. In a toilet tissue dispenser having a frame with sides and a spindle for a roll of tissue, said spindle having opposed spindle pins for rotation in said frame sides, the improvement including in combination:

slot means defining a slot in one of said sides for slidingly receiving one of said spindle pins, said slot defining a first plane;

a locking member carried in said one side and movable between a locked position blocking said slot and an unlocked position not blocking said slot; and a lock mechanism mounted in said one side for rotating said locking member in a plane perpendicular to said first plane, said lock mechanism including a sleeve mounted in said one side and a key operated tumbler rotatably carried in said sleeve, with said locking member carried on said tumbler for rotation into and out of said slot, said locking member including a plate having a wing for moving into and out of said slot.

2. A dispenser as defined in claim 1 wherein said plate has opposed wings and opposed arcuate sections between said wings, with each of said arcuate sections having first portion of one radius and a second portion of a second different radius.

3. In a toilet tissue dispenser having a frame with sides and a spindle for a roll of tissue, said spindle having opposed spindle pins for rotation in said frame sides, the improvement including in combination:

slot means defining a slot in one of said sides for slidingly receiving one of said spindle pins, said slot defining a first plane;

a locking member carried in said one side and movable between a locked position blocking said slot and an unlocked position not blocking said slot; and a lock mechanism mounted in said one side for rotating said locking member in a plane perpendicular to said first plane, said lock mechanism including a sleeve mounted in said one side and a key operated tumbler rotatably carried in said sleeve, with said locking member carried on said tumbler for rotation into and out of said slot, said locking member including a plate having a wing for moving into and out of said slot;

said frame having a mounting surface and said one side having an internal cavity open to said mounting surface providing access to said lock tumbler from said mounting surface, and said one side having an opening to said cavity for slidingly receiving said lock sleeve, and including attaching means positionable in said cavity from said mounting surface and engagable with said lock tumbler for retaining said lock in position in said one side.

4. In a toilet tissue dispenser having a frame with a central arm and spaced side arms, and spindles for rolls of tissue, with each of said spindles having opposed spindle pins for rotation in said frame between said central arm and a side arm, the improvement including in combination:

slot means defining opposed slots in said central arm for slidingly receiving a spindle pin of each of said spindles;

a locking member carried in said central arm and movable between a locked position blocking said slots and an unlocked position not blocking said slots; and a lock mechanism mounted in said central arm for actuating said locking member, said lock mechanism including a sleeve mounted in said central arm and a key operated tumbler rotatably carried in said sleeve, with said locking member carried on said tumbler for rotation into and out of said slots, said locking member including a plate having opposed wings for moving into and out of said slots.

5. A dispenser as defined in claim 4 wherein said plate has opposed arcuate sections between said wings, with each of said arcuate sections having first portion of one radius and a second portion of a second different radius.

6. In a toilet tissue dispenser having a frame with a central arm and spaced side arms, and spindles for rolls of tissue, with each of said spindles having opposed spindle pins for rotation in said frame between said central arm and a side arm, the improvement including in combination:

slot means defining opposed slots in said central arm for slidingly receiving a spindle pin of each of said spindles;

a locking member carried in said central arm and movable between a locked position blocking said slots and an unlocked position not blocking said slots; and a lock mechanism mounted in said central arm for actuating said locking member;

said frame having amounting surface and said central arm having an internal cavity open to said mounting surface providing access to said lock tumbler from said mounting surface, and said central arm having an opening to said cavity for slidingly receiving said lock sleeve, and including attaching means positionable in said cavity from said mounting surface and engagable with said lock tumbler for retaining said lock mechanism in position in said central arm.

* * * * *